US006153022A

United States Patent [19]

Yoshida et al.

[11] Patent Number: 6,153,022

[45] **Date of Patent: *Nov. 28, 2000**

[54] COMPOSITION AND PROCESS FOR SURFACE TREATMENT OF ALUMINUM AND ITS ALLOYS

[75] Inventors: Masayuki Yoshida, Yokohama; Ryoji Ehara, Kanagawa-ken, both of Japan

[73] Assignee: Henkel Corporation, Gulph Mills, Pa.

[ * ] Notice: This patent is subject to a terminal disclaimer.

[21] Appl. No.: 09/051,583

[22] PCT Filed: Oct. 15, 1996

[86] PCT No.: PCT/US96/16132

§ 371 Date: Apr. 13, 1998

§ 102(e) Date: Apr. 13, 1998

[87] PCT Pub. No.: WO97/13887

PCT Pub. Date: Apr. 17, 1997

[30] Foreign Application Priority Data

Oct. 13, 1995 [JP] Japan ..... H7-265501

[51] Int. Cl.[7] ..... C23C 22/07

[52] U.S. Cl. ..... 148/253; 148/260; 148/275; 427/388.4

[58] Field of Search ..... 148/253, 259, 148/260, 274, 275; 427/372.2, 385.5, 388.4, 444

[56] References Cited

U.S. PATENT DOCUMENTS

| | | | |
|---|---|---|---|
| 2,438,877 | 3/1948 | Spruance, Jr. | 148/6.16 |
| 4,714,752 | 12/1987 | Sokalski | 148/259 |
| 4,963,596 | 10/1990 | Lindert et al. | 526/313 |
| 4,970,264 | 11/1990 | Lindert et al. | 525/328.8 |
| 5,039,770 | 8/1991 | Lindert et al. | 526/312 |
| 5,063,089 | 11/1991 | Lindert et al. | 427/354 |
| 5,068,299 | 11/1991 | Lindert et al. | 526/313 |
| 5,116,912 | 5/1992 | Lindert et al. | 525/340 |
| 5,246,507 | 9/1993 | Kodama et al. | 148/250 |
| 5,266,410 | 11/1993 | Lindert et al. | 428/461 |
| 5,356,491 | 10/1994 | Aoki et al. | 148/253 |
| 5,427,632 | 6/1995 | Dolan | 148/259 |
| 5,728,234 | 3/1998 | Aoki et al. | 148/259 |
| 5,733,386 | 3/1998 | Yoshida | 148/259 |

FOREIGN PATENT DOCUMENTS

| | | |
|---|---|---|
| 61-091369 | 5/1986 | Japan . |
| 1-172406 | 7/1989 | Japan . |
| 1-177379 | 7/1989 | Japan . |
| 1-177380 | 7/1989 | Japan . |
| 2-000608 | 1/1990 | Japan . |
| 2-000609 | 1/1990 | Japan . |

*Primary Examiner*—Prince Willis
*Assistant Examiner*—Andrew L. Oltmans
*Attorney, Agent, or Firm*—Wayne C. Harper; Stephen D. Harper; Novell E. Wisdom, Jr.

[57] ABSTRACT

An aqueous liquid surface treatment composition having a pH value not more than 6.5 and containing phosphoric acid ions, condensed phosphoric acid ions, an oxidizing agent, and a water-soluble polymer consisting, except for end groups, of polymer units expressed by formula (I), in a weight ratio of 0.1 to 30:0.1 to 10:0.1 to 10:0.1 to 20 respectively, when brought into contact with an aluminiferous metal surface, rapidly forms on the surface a conversion coating that has good corrosion resistance and adhesion to subsequently applied organic coatings such as paint and is less easily damaged by mechanical stresses than prior art conversion coatings.

(I)

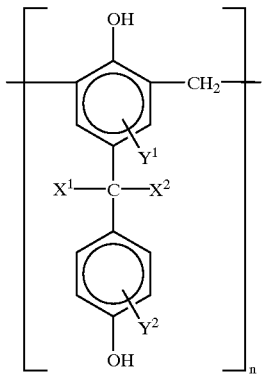

20 Claims, No Drawings

COMPOSITION AND PROCESS FOR SURFACE TREATMENT OF ALUMINUM AND ITS ALLOYS

TECHNICAL FIELD

The present invention relates to a novel composition and method for the surface treatment of aluminum and its alloys, such as aluminum-manganese alloys, aluminum-magnesium alloys, and aluminum-silicon alloys, that contain at least 45% by weight of aluminum, all of these being jointly hereinafter briefly designated as "aluminiferous metals", in which the surface of an aluminiferous metal is provided with better corrosion resistance and adhesion to paint or synthetic resin film before said surface is painted or is laminated to a synthetic resin film. One field in which the present invention may be particularly effectively applied is the surface treatment of aluminiferous coils.

BACKGROUND ART

Chromate treatments are presently being used for the most part in the industrial surface treatment of aluminum coils. Typical examples of chromate treatments include chromic acid chromate conversion treatments and phosphoric acid chromate conversion treatments. Chromic acid chromate conversion treatment solutions were put to practical use around 1950 and are still widely used for fin members and the like in heat exchangers. This chemical conversion treatment solution consists primarily of chromic acid ($CrO_3$) and hydrofluoric acid (HF), with a promoter added, and forms a film containing some hexavalent chromium. Phosphoric acid chromate conversion treatment solutions are based on the invention in U.S. Pat. No. 2,438,877 from 1945. This chemical conversion treatment solution contains chromic acid ($CrO_3$), phosphoric acid ($H_3PO_4$), and hydrofluoric acid (HF). The film that is formed consists primarily of hydrated chromium phosphate ($CrPO_4.4H_2O$). Since the film does not contain hexavalent chromium, it is widely used at present for the paint undercoating treatment of beverage can bodies, particularly drawn and ironed aluminum cans and lids. However, in the interests of environmental protection, a need has arisen for surface treatment solutions which contain no chromium. In recent years, the painting or lamination following such surface treatment has been followed by an increasingly wide range of shaping processes, with the need for increasingly stringent levels of processing, but films made from inorganic systems such as chromate suffer from problems; e.g., the film is broken when bent sharply, preventing adequate performance from being realized, and the like. There is thus strong demand for the development of a technique for forming a flexible film with better corrosion resistance and/or adhesion in articles of manufacture that are shaped after the conversion coating is formed.

Treatment solutions or methods intended to provide the surface of aluminiferous metals with corrosion resistance and paint adhesion using a water-soluble resin have been proposed in Japanese Laid-Open Patent Applications 61-91369, 1-172406, 1-177379, 1-177380, 2-608, 2-609, and others. In these conventional treatment methods, the metal surface is treated with a solution containing a derivative of a polyhydric phenol compound. Problems in these conventional methods, however, are that it is difficult to form a sufficiently stable film in a short period of time on the surface of aluminiferous metal materials, and adequate corrosion resistance cannot be obtained.

DISCLOSURE OF THE INVENTION

Problems to Be Solved by the Invention

The present invention is intended to remedy the aforementioned drawbacks of the conventional technology, and more specifically is intended to offer a novel composition and method for surface treating aluminiferous metals, which allow the surface of an aluminiferous metal to be provided in a short period of time with better corrosion resistance and paint or laminated film adhesion, without the use of chromium, and which also allow a film with better workability to be formed.

SUMMARY OF THE INVENTION

It has been found that an aqueous liquid surface treatment composition containing phosphoric acid ions, condensed phosphoric acid ions, an oxidizer, and a water-soluble polymer with a specific structure and that has a pH within a specific range forms a film with better corrosion resistance and paint or laminated film adhesion, as well as better workability, when a surface of an aluminiferous metal is brought into contact with such a surface treatment composition.

More particularly, a composition according to the invention for the surface treatment of an aluminiferous metal comprises, preferably consists essentially of, or more preferably consists of, water and:

(A) a component of ions of orthophosphoric acid;
(B) a component of ions of condensed phosphoric acid(s);
(C) a component of oxidizing agent; and
(D) a component of molecules of water-soluble polymer and/or oligomers conforming, except for end groups, to the following general formula (I):

(I)

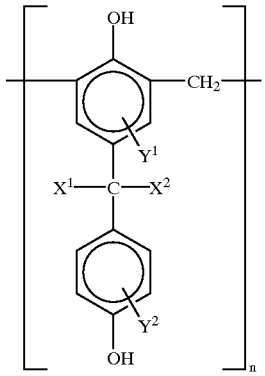

in which each of $X^1$ and $X^2$ independently of each other and independently from one unit of the polymer, said unit being defined as represented by a modification of formula (I) above in which the square brackets and the subscript n are omitted, to another unit of the polymer represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following general formulas (II) and (III):

(II)

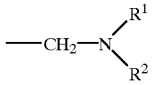

-continued (III)

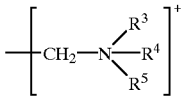

in which each of $R^1$, $R^2$, $R^3$, $R^4$, and $R^5$ in each of general formulas (II) and (III) independently represents a $C_1$ to $C_{10}$ alkyl group or a $C_1$ to $C_{10}$ hydroxyalkyl group; one moiety "Z" may be identical to or may differ from any other moiety "Z" in the polymer molecule, so long as each "Z" conforms to one of the general formulas (II) and (III); and n represents a positive integer, which may be the same as or different from the value of n for any other polymer molecule; in addition, in component (D) as a whole: the average value for the number of Z moieties substituted on each phenyl ring in the polymer molecule[1], which may be referred to hereinafter as "the average value for Z moiety substitution", is from 0.2 to 1.0; the average value of n, which may be referred to hereinafter as "the average degree of polymerization", is from 2 to 50, and, because it is an average, need not be an integer;

[1] For example, if a polymer with an average degree of polymerization of 10, which contains 20 benzene rings, has only 10 of these 20 benzene rings each substituted with one group Z, the mean group Z substitution rate of the polymer is:

$$((1\times10)+(0\times10'))/20=0.5$$

and, optionally, one or both of the following components:

(E) a component of aluminum sequestering agent that is not part of any of the previously recited components; and (F) a component of antifoam agent that is not part of any of the previously recited components, and in the composition as a whole, the aforementioned phosphoric acid ions (A), condensed phosphoric acid ions (B), oxidizing agent (C), and water-soluble polymer (D) are present in a weight ratio (A):(B):(C):(D) of 0.1 to 30:0.1 to 10:0.1 to 10:0.1 to 20. A composition according to the invention may be immediately suitable for use as such in treating aluminiferous metal, in which instance it is called a working composition, or it may be suitable for diluting with additional water to form a working composition, in which instance it is called a concentrate composition. Some compositions are suitable for both purposes.

A process for the surface treatment of an aluminiferous metal according to the present invention is characterized by the fact that an aqueous surface treatment solution which contains the aforementioned surface treatment composition pertaining to the present invention and which has a pH value no more than 6.5 is brought into contact with the surface of an aluminiferous metal, preferably for a total of 1 to 60 seconds, and the surface which has thus contacted preferably is then rinsed with water, and then is dried and preferably heated.

DETAILED DESCRIPTION OF THE INVENTION, INCLUDING PREFERRED EMBODIMENTS

Orthophosphoric acid, having the chemical formula $H_3PO_4$ and herein usually designated simply as "phosphoric acid" unless the context requires differentiating it from other phosphoric acids, and any water soluble salt or acid salt of orthophosphoric acid that does not act adversely to the objects of the invention may be used as a source of component (A) of a composition according to the invention as defined above, and any such salt is to be understood, for the purpose of the preferences indicated below, as contributing its full stoichiometric equivalent as orthophosphate ions (i.e., $PO_4^{-3}$) to the concentration thereof in any composition according to the invention, irrespective of the actual degree of ionization that may prevail in the composition. The phosphoric acid ions content ranges from 0.1 to 30 weight parts, and preferably 0.5 to 5 weight parts, per 0.1 to 20 weight parts of water-soluble polymer (D) in the aforementioned ratio. A phosphoric acid ions content of less than 0.1 weight part in the aforementioned blend ratio often results in inadequate reactivity between the surface treatment solution and the surface of the metal substrate being coated, as well as in an inadequately formed film. More than 30 weight parts in this ratio does not harm formation of a favorable conversion coating but is uneconomical because of the higher cost of the treatment solution and lack of any offsetting benefit compared with compositions containing somewhat less of this component.

Similarly, one or two or more types selected from among pyrophosphoric acid, tripolyphosphoric acid and tetrapolyphosphoric acid, and the salts of all of these acids, can be used to provide the condensed phosphoric acid ions in a water-based composition of this invention, but the invention is not limited to the use of these materials. Any water soluble source of any phosphate anions that contain at least two atoms of phosphorus each may be used, and is to be understood for the purposes of the preferences below as supplying its full stoichiometric equivalent as condensed phosphate anions to the composition used according to the invention, irrespective of the actual degree of ionization that exists in the composition. For example, pyrophosphoric acid ($H_4P_2O_7$), sodium pyrophosphate ($Na_4P_2O_7$) and like compounds can be used to provide pyrophosphate ions. In a surface treatment composition according to the present invention, the content of the condensed phosphoric acid ions component (B) ranges from 0.1 to 10 weight parts, and preferably 0.5 to 3.0 weight parts, per 0.1 to 20 weight parts of water-soluble polymer (D). A condensed phosphoric acid ions content of less than 0.1 weight part in the aforementioned ratio normally results in a surface treatment solution with weak etching action, preventing a film from being adequately formed. A content of more than 10 weight parts usually results in a surface treatment solution with etching action that is too strong, which inhibits the film-forming reaction.

In a surface treatment composition according to the present invention, the oxidizing agent preferably comprises, more preferably consists essentially of, or still more preferably consists of one or more substances selected from the group consisting of hydrogen peroxide, chlorates, and nitrites; the use of hydrogen peroxide is most preferred. The content of oxidizing agent component (C) in the aforementioned ratio for the surface treatment composition according to the present invention ranges from 0.1 to 10 weight parts, and preferably 2 to 5 weight parts, per 0.1 to 20 weight parts of water-soluble polymer component (D). An oxidizing agent content of less than 0.1 weight part usually results in a treatment solution with weak etching action, preventing an adequate film from being formed. More than 10 weight parts usually results in a treatment solution with etching action that is too strong, which inhibits the film-forming reaction.

The water-soluble polymer used in the present invention is a water-soluble polymer (a term intended herein to include oligomers) that has an average degree of polymerization of 2 to 50, or preferably of 2 to 20, and that contains, preferably consists essentially of, or more preferably consists of (except for end groups) polymer units as described above in connection with general formula (I).

When the alkyl or hydroxyalkyl groups represented by $X^1$ and $X^2$ in general formula (I) have 6 or more carbon atoms, the resulting polymer becomes bulky, usually causing steric hindrance and preventing a compact film with good corrosion resistance from being obtained.

When the average value for Z substitutions is less than 0.2, the resulting polymer normally has poor water solubility, and the resulting surface treatment composition stability is usually inadequate. When the average value for Z moiety substitution is more than 1.0, and thus contains a substantial fraction of benzene rings substituted by two or more Z groups, the polymer usually has such a high water solubility that a composition containing it as component (D) has great difficulty in forming a satisfactorily protective surface film.

The alkyl or hydroxyalkyl groups expressed by $R^1$, $R^2$, $R^3$, $R^4$, and $R^5$ in general formulas (II) and (III) have 1 to 10 carbon atoms. A number of carbon atoms of 11 or more usually results in a polymer molecule that is too bulky, leading to a film with poor density and insufficient corrosion resistance.

In a surface treatment composition according to the present invention, the content of the water-soluble polymer component (D), in terms of the aforementioned ratios to other components, is 0.1 to 20 weight parts, and preferably 0.5 to 5 weight parts, per 0.1 to 30 weight parts of phosphoric acid ions (A). When this ratio is less than 0.1 weight part, it is difficult to form a film on the surface of aluminiferous metals with the surface treatment composition, whereas more than 20 weight parts in this ratio is uneconomical because of the higher cost of the resulting surface treatment and lack of any substantial improvement over the results achieved with a composition according to the invention containing 20 or fewer parts in this ratio.

Although not narrowly limited, the pH of a working surface treatment composition according to the present invention is preferably no more than 6.5, and even more preferably is between 2.0 and 6.5. When the pH of the surface treatment composition is higher than 6.5, the polymer of formula (I) in the resulting surface treatment composition tends to precipitate, impairing the treatment composition stability and its use life. When the pH is lower than 2.0, the etching action of the surface treatment composition on the surface of the metal material is very strong, making it difficult to form a surface film. The pH of the surface treatment composition can be adjusted using an acid such as phosphoric acid, nitric acid, and hydrochloric acid, or an alkali such as sodium hydroxide, sodium carbonate, and ammonium hydroxide. Hydrofluoric acid may be used to adjust the pH when wastewater disposal is not a problem.

In a surface treatment method according to the present invention, the aforementioned surface treatment solution preferably has a pH of 2.0 to 6.5 and contains from 1 to 30 grams per liter (hereinafter usually abbreviated as "g/l") of phosphoric acid ions, from 0.1 to 10 g/l of condensed phosphoric acid ions, from 0.1 to 10 g/l of oxidizing agent, and from 0.1 to 20 g/l of water-soluble polymer component (D) as described above. When the concentration of phosphoric acid ions in a surface treatment composition according to the invention is lower than 0.1 g/l, a surface film is usually inadequately formed, whereas more than 30 g/l is uneconomical because of higher costs. When the concentration of the condensed phosphoric acid ions is lower than 0.1 g/l, the etching action of the resulting surface treatment composition is usually too weak, and a surface film is inadequately formed, whereas more than 10 g/l results in a surface treatment composition with etching properties that are so strong that the film-forming reaction is hindered. When the oxidizing agent concentration is lower than 0.1 g/l, the etching action of the resulting surface treatment composition is weak, usually preventing the formation of an adequate film, whereas more than 10 g/l results in a surface treatment composition with etching action that is too high, which hinders the film-forming reaction. When the concentration of the water-soluble polymer component (D) is lower than 0.1 g/l, the resulting surface treatment composition usually has inadequate film formability, whereas more than 20 g/l is economically disadvantageous because of higher costs.

When aluminum ions that have eluted from the aluminiferous metal become mixed with the surface treatment composition, the water-soluble polymer (D) and the metal ions sometimes form a complex and produce precipitation. In such instances, an aluminum sequestering agent should be added to the surface treatment composition. Examples of useful aluminum sequestering agents include, but are not limited to, ethylene diamine tetra-acetic acid, 1,2-cyclohexane-diamine tetra-acetic acid, triethanolamine, gluconic acid, heptogluconic acid, oxalic acid, tartaric acid, malic acid, and organophosphonic acids. When the use of hydrofluoric acid poses no problems for wastewater treatment, it may be used as a sequestering agent.

In a method of the present invention, a working surface treatment composition as described above is brought into contact, preferably for a total of 1 to 60 seconds and independently preferably at a temperature within a range from 30 to 65° C., with a surface of an aluminiferous metal. The film formed on the surface of the metal material is then preferably rinsed with water, and thereafter preferably is heated and dried. Contact between the aluminiferous metal and a working composition may be established by any convenient method, among which immersion of the substrate in a bath of the working composition and spraying the working composition on the metal are most common. A contact time of less than 1 second usually results in inadequate formation of a corrosion-resistant film, whereas a contact time of more than 60 seconds yields no greater benefits and thus leads to less operational efficiency.

When a spray treatment is used, the surface treatment composition sometimes foams and thus causes problems in the film that is formed. Although the presence or absence of foaming and the extent of such foaming depends largely on the spraying equipment and conditions, a defoaming agent should be added to the surface treatment composition when foaming is not suitably avoided by modification of the spraying equipment and conditions. The type of defoaming agent, the amount used, and so forth are not narrowly limited, but the adhesion between the resulting film and the paint or laminated film should not be compromised.

The film formed on the surface of the aluminiferous metal in a process according to the invention is believed to be a film of an organic-inorganic composite consisting primarily of phosphates and water-soluble polymer (resin) (D). The metal substrate is etched by the ions of the phosphoric acid and condensed phosphoric acid, at which time the pH becomes elevated in some areas at the interface, resulting in the precipitation of phosphates on the surface. The amino groups (included in the groups Z) of the water-soluble polymer (D) have chelating action, and are believed to form a type of coordination compound with the regenerated surface of the metal substrate produced by the etching. Although the organic-inorganic composite film is basically formed as a result of the two aforementioned actions, the additional presence of the condensed phosphoric acid ions in the surface treatment composition appears to allow some water-soluble polymer-metal coordination compound(s) to be more readily formed, thereby allowing a stable organic-inorganic complex film to be formed on the metal surface within a wide pH range.

After a coating film has been formed in a process according to the invention, the film can be and preferably is heated to allow the polymer from component (D) of the working composition according to the invention that was used, and that was incorporated into the coating film formed on the surface, to undergo further polymerization on the surface. At least one minute at 200° C. (in the normal ambient natural atmosphere) is sufficient for the heating conditions.

A preferred expanded treatment process step sequence, using a surface treatment composition according to the present invention, is outlined below.

(1) Surface cleaning/degreasing (any acidic, alkaline, or solvent type);
(2) Rinsing with water;
(3) Surface treatment (by method of the present invention);
(4) Rinsing with water;
(5) Deionized water rinsing;
(6) Heating and drying;
(7) Painting or film lamination.

Before the method of the present invention is implemented, the surface of the metal material is preferably cleaned so that it is degreased of oil such as rolling oil or the like remaining on the surface of the aluminiferous metal that is being treated. No particular restrictions are imposed on the type of degreasing agent or the degreasing method used in this step. The degreased material is then preferably rinsed with water. The rinsing is intended to remove the degreasing composition from the surface; therefore, any rinsing method may be used, provided that the degreasing composition is removed from the surface. The surface treatment of the method according to the present invention is then implemented. The surface of the aluminiferous metal being treated is the preferably further rinsed with water. This rinsing is intended to remove the surface treatment composition, so any rinsing method may be used, provided that the unreacted surface treatment composition is removed from the surface. The heating and drying are intended to dry off the rinsing water, with no narrow restrictions imposed on the method, drying temperature, drying time, or the like, although hot air drying or the like is generally useful for industrial purposes. The surface of the aluminiferous metal that has been surface treated is then painted or laminated with film. The coating formed by a method according to the present invention has good adhesion to paint or laminated films. Since the coating formed by means of the present invention is also flexible, it also has excellent performance after processing such as folding or drawing.

The aluminiferous metals used in the method according to the present invention include forms such as sheets, bars, tubes, wires, and the like. No restrictions whatever are imposed on the dimensions and configuration of the metal, although the method according to the present invention is especially effective when used on aluminiferous metal coils.

The present invention is described in further detail below with reference to specific working and comparison examples.

EXAMPLES AND COMPARISON EXAMPLES

Methods of Evaluation (1) Corrosion Resistance

The corrosion resistance of aluminum materials (resistance to darkening from boiling water) was evaluated by the following test: Treated aluminum objects were bent into the shape of a U around a round bar with a diameter of 1 millimeter (hereinafter usually abbreviated as "mm"); these were immersed for 30 minutes in boiling tap water; and the degree of discoloration (darkening) in the bent parts was visually assessed. No darkening was rated as "○", partial darkening was rated as "Δ", and total darkening was rated as "×".

(2) Paint Adhesion

Paint adhesion was tested in the following manner: Polyvinyl chloride paint for cans was painted to a thickness of between 5 and 10 micrometers (hereinafter usually abbreviated as "μm") on the surface of treated aluminum, followed by 1 minute of baking at 260° C.; the samples were cut into rectangles 5×150 mm; the painted surfaces were thermally bonded via a polyamide film to form test pieces; the bonded surfaces were separated by the 180 degree peel test method; and the peel strength was evaluated at that time. The greater the peel strength, the better the paint adhesion. In general, a peel strength of 4.0 kilograms-force (hereinafter usually abbreviated as "kgf") or more per 5 mm of width is considered excellent for practical purposes.

(3) Wastewater Disposability

Used surface treatment composition waste was diluted twenty-fold with water, and the concentration of hexavalent chromium in the thus formed composition was measured. For the purposes of environmental protection, no chromium should be detected.

Example 1

An aluminum-magnesium alloy sheet (alloy according to Japanese Industrial Standard, hereinafter usually abbreviated as "JIS", A5182) was degreased by spraying with a 2% aqueous solution of an alkaline degreaser (trade name: FINECLEANER® 4377K, by Nihon Parkerizing) for 5 seconds at 60° C., and was then rinsed clean with water. The sheet was then sprayed for 3 seconds at 60° C. with Surface Treatment Composition 1 having the ingredients noted below, with the balance being water; it was then rinsed with tap water, then sprayed and washed for 10 seconds with deionized water having a specific resistivity of at least 3,000,000 ohm-centimeters, and was then dried for 2 minutes in a hot air drying furnace at 80° C.

| Surface Treatment Composition 1 | |
|---|---|
| 75% Phosphoric acid (i.e., $H_3PO_4$) | 10.0 g/l ($PO_4^{3-}$:7.2 g/l) |
| Sodium pyrophosphate (i.e., $Na_4P_2O_7.10H_2O$) | 3.0 g/l ($P_2O_7^{4-}$:1.2 g/l) |
| 31% Hydrogen peroxide in water | 10.0 g/l ($H_2O_2$:3.1 g/l) |
| Polymer (1) - solids part | 2.0 g/l |
| pH 4.0 (Adjusted with sodium hydroxide) | |

Water Soluble Polymer (1) was according to general formula (I) when: the average value of n=5; each of $X^1$ and $X^2$ represents a hydrogen atom; each of $Y^1$ and $Y^2$ represents a $—CH_2N(CH_3)_2$ moiety or hydrogen atom; and the average Z moiety substitution number=0.50

Example 2

Aluminum alloy materials were degreased and rinsed clean in the same manner as in Example 1, and they were then treated by immersion for 10 seconds at 40° C. using Surface Treatment Composition 2 having the ingredients shown below, with the balance being water. This treatment was followed by rinsing and drying under the same conditions as in Example 1.

| Surface Treatment Composition 2 | |
|---|---|
| 75% Phosphoric acid (i.e., $H_3PO_4$) | 10.0 g/l ($PO_4^{3-}$:7.2 g/l) |
| Sodium pyrophosphate (i.e., $Na_4P_2O_7.10H_2O$) | 3.0 g/l ($P_2O_7^{4-}$:1.2 g/l) |
| 31% Hydrogen peroxide in water | 15.0 g/l ($H_2O_2$:4.6 g/l) |
| Polymer (2) - solids part | 0.4 g/l |
| pH 3.0 (Adjusted with sodium carbonate) | |

Water soluble polymer (2) was according to general formula (I) when: the average value of n=5; each of $X^1$ and $X^2$=a —$C_2H_5$ moiety; each of $Y^1$ and $Y^2$=a —$CH_2N(CH_2CH_2OH)_2$ moiety or a hydrogen atom; and the average value for Z moiety substitution=0.25.

Example 3

Aluminum alloy sheets were degreased and rinsed clean in the same manner as in Example 1, were then spray treated for 1 second at 65° C. using Surface Treatment Composition 3 containing the ingredients shown below, with the balance being water, then rinsed and dried under the same conditions as in Example 1.

| Surface Treatment Composition 3 | |
|---|---|
| 75% Phosphoric acid (i.e., $H_3PO_4$) | 20.0 g/l ($PO_4^{3-}$:14.4 g/l) |
| Sodium pyrophosphate (i.e., $Na_4P_2O_7.10H_2O$) | 6.0 g/l ($P_2O_7^{4-}$:2.4 g/l) |
| 31% Hydrogen Peroxide in water | 15.0 g/l ($H_2O_2$:4.6 g/l) |
| Polymer (3) - solids part | 8.0 g/l |
| pH 4.0 (Adjusted with sodium hydroxide) | |

Water soluble polymer (3) was according to general formula (I) when: the average value of n=15; each of $X^1$ and $X^2$=a —$C_2H_5$ moiety; each of $Y^1$ and $Y^2$=a —$CH_2N(CH_2CH_2OH)_2$ moiety or a hydrogen atom; and the average value for Z moiety substitution=1.0.

Example 4

Aluminum alloy sheets were degreased and rinsed clean in the same manner as in Example 1, were then spray treated for 30 seconds at 40° C. using Surface Treatment Composition 4 containing the ingredients shown below, with the balance being water, then rinsed and dried under the same conditions as in Example 1.

| Surface Treatment Composition 4 | |
|---|---|
| 75% Phosphoric acid (i.e., $H_3PO_4$) | 20.0 g/l ($PO_4^{3-}$:14.4 g/l) |
| Sodium tripolyphosphate (i.e., $Na_5P_3O_{10}$) | 1.2 g/l ($P_3O_{10}^{4-}$:0.8 g/l) |
| 43% Sodium chlorate in water | 10.0 g/l ($NaClO_3$:4.3 g/l) |
| Polymer (4) - solids part | 1.0 g/l |
| pH 4.0 (Adjusted with aqueous ammonia) | |

Water soluble polymer (4) was according to general formula (I) when: the average value of n=15; each of $X^1$ and $X^2$ represents a hydrogen atom; each of $Y^1$ and $Y^2$ represents a —$CH_2N(CH_2OH)_2$ moiety or a hydrogen atom; and the average value for Z moiety substitution=0.50

Example 5

Aluminum alloy sheets were degreased and rinsed clean in the same manner as in Example 1, were then spray treated for 5 seconds at 50° C. using Surface Treatment Composition 5 containing the ingredients shown below, with the balance being water, then rinsed and dried under the same conditions as in Example 1.

| Surface Treatment Composition 5 | |
|---|---|
| 75% Phosphoric acid (i.e., $H_3PO_4$) | 20.0 g/l ($PO_4^{3-}$:14.4 g/l) |
| Pyrophosphoric acid (i.e., $H_4P_2O_7$) | 1.0 g/l ($P_2O_7^{4-}$:0.98 g/l) |
| 31% Hydrogen Peroxide in water | 5.0 g/l ($H_2O_2$:1.6 g/l) |
| Polymer (5) - solids part | 1.0 g/l |
| pH 3.5 (Adjusted with aqueous ammonia) | |

Water soluble polymer (5) was according to general formula (I) when: the average value of n=20; each of $X^1$ and $X^2$=a hydrogen atom; each of $Y^1$ and $Y^2$=a —$CH_2N(CH_2CH_2CH_2OH)_2$ moiety or a hydrogen atom; and the average value for Z moiety substitution=0.75.

Comparative Example 1

Aluminum alloy sheets were degreased and rinsed clean in the same manner as in Example 1, and they were then spray treated for 5 seconds at 50° C. using Surface Treatment Composition C1 having the ingredients set forth below, with the balance being water. This treatment was followed by rinsing and drying under the same conditions as in Example 1.

| Surface Treatment Composition C1 - with no condensed phosphoric acid ions or oxidizing agent | |
|---|---|
| 75% Phosphoric acid (i.e., $H_3PO_4$) | 20.0 g/l ($PO_4^{3-}$:14.4 g/l) |
| Polymer (6) - solids part | 1.0 g/l |
| pH 3.5 (Adjusted with aqueous ammonia) | |

Water soluble polymer (6) was according to general formula (I) when: the average value of n=10; each of $X^1$ and $X^2$=a hydrogen atom; each of $Y^1$ and $Y^2$=a —$CH_2N(CH_2CH_2CH_2OH)_2$ moiety or a hydrogen atom; and the average value for Z moiety substitution=0.75.

Comparative Example 2

Aluminum alloy sheets were degreased and rinsed clean in the same manner as in Example 1, were then spray treated for 2 seconds at 50 CC using a 5% aqueous solution of a commercially available phosphoric acid chromate type of chemical conversion composition (tradename: ALCHROME® K 702, by Nihon Parkerizing). The treatment was followed by rinsing and drying under the same conditions as in Example 1.

Comparative Example 3

Aluminum alloy sheets were degreased and rinsed clean in the same manner as in Example 1, were then spray treated for 10 seconds at 50° C. using a 6% aqueous solution of a commercially available zirconium phosphate type of chemical conversion composition (tradename: AEROSIL™ 404, by Nihon Parkerizing). The treatment was followed by rinsing and drying under the same conditions as in Example 1.

Table 1 shows the results obtained in the evaluations of the above noted Examples 1 through 5 and Comparative Examples 1 through 3.

TABLE 1

| | Corrosion Resistance | Paint Adhesion (Peel Strength, kgf/5 mm) | Wastewater Disposability ($Cr^{+6}$, g/l) |
|---|---|---|---|
| Example 1 | 0 | 4.0 | none detected |
| Example 2 | 0 | 4.0 | none detected |
| Example 3 | 0 | 4.0 | none detected |
| Example 4 | 0 | 4.0 | none detected |
| Example 5 | 0 | 4.0 | none detected |
| Comparative Example 1 | x | 1.5 | none detected |
| Comparative Example 2 | x | 4.0 | 0.2 |
| Comparative Example 3 | x | 1.5 | none detected |

It is apparent from the results in Table 1 that Examples 1 through 5 which used a method according to the present invention had better corrosion resistance, adhesion, and wastewater disposability.

In Comparative Example 1, the surface treatment composition contained no condensed phosphoric acid ions or oxidizing agent, resulting in a film with inadequate corrosion resistance and paint adhesion. In Comparative Examples 2 and 3, conventional surface treatment compositions were used, resulting in films with low corrosion resistance. In Comparative Example 2, the wastewater contained hexavalent chromium, while in Comparative Example 3, the paint adhesion was poor.

Benefits of the Invention

It is apparent from the aforementioned description that the surface treatment composition and method according to the present invention allow a chemical conversion film with better corrosion resistance and paint adhesion to be formed on the surfaces of aluminiferous metals before they are painted. The surface treatment composition and method according to the present invention are non-chromium and non-fluorine types, and have the exceptional merit of alleviating the burden of wastewater disposal.

The invention claimed is:

1. A liquid composition of matter suitable for use as such, after dilution with water, or both as such and after dilution with water for the surface treatment of aluminiferous metals, said composition comprising water and:

(A) a component of ions of orthophosphoric acid;

(B) a component of ions of condensed phosphoric acid(s);

(C) a component of oxidizing agent; and (D) a component of molecules of water-soluble polymers, oligomers, or both polymers and oligomers, each of said molecules conforming, except for end groups, to the following general formula (I):

(I)

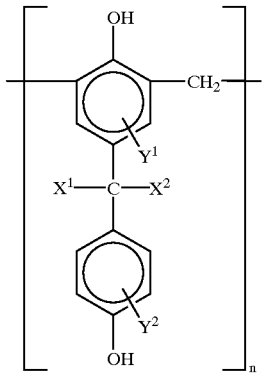

in which each of $X^1$ and $X^2$ independently of each other and independently from one unit of the molecule, said unit being defined as represented by a modification of formula (I) above in which the square brackets and the subscript n are omitted, to another unit of the molecule represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following general formulas (II) and (III):

(II)

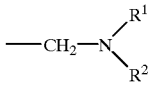

(III)

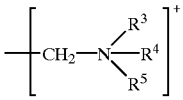

in which each of $R^1$, $R^2$, $R^3$, $R^4$, and $R^5$ in each of general formulas (II) and (III) independently represents a $C_1$ to $C_{10}$ alkyl group or a $C_1$ to $C_{10}$ hydroxyalkyl group; one moiety "Z" may be identical to or may differ from any other moiety "Z" in the same or another molecule, so long as each "Z" moiety conforms to one of the general formulas (II) and (III); and n represents a positive integer, which may be the same as or different from the value of n for any other molecule in component (D); and in component (D) as a whole: the average value for the number of Z moieties substituted on each phenyl ring in the polymer molecule, which may be referred to hereinafter as "the average value for Z moiety substitution", is from 0.2 to 1.0; the average value of n, which may be referred to hereinafter as "the average degree of polymerization", is from 2 to 50, and, because it is an average, need not be an integer, in said composition as a whole, the aforementioned phosphoric acid ions (A), condensed phosphoric acid ions (B), oxidizing agent (C), and water-soluble polymer (D) being present in a weight ratio (A):(B):(C):(D) of 0.1 to 30:0.1 to 10:0.1 to 10:0.1 to 20.

2. A composition as defined in claim 1, wherein the oxidizing agent component includes at least one material selected from the group consisting of hydrogen peroxide, chlorates, and nitrites.

3. A composition as defined in claim 2, wherein phosphoric acid ions (A), condensed phosphoric acid ions (B), oxidizing agent (C), and water-soluble polymer (D) are present in a weight ratio (A):(B):(C):(D) of 0.5 to 5:0.5 to 3.0:2 to 5:0.5 to 5.

4. A composition as defined in claim 1, wherein phosphoric acid ions (A), condensed phosphoric acid ions (B), oxidizing agent (C), and water-soluble polymer (D) are present in a weight ratio (A):(B):(C):(D) of 0.5 to 5:0.5 to 3.0:2 to 5:0.5 to 5.

5. A method for the treatment of an aluminiferous metal surface, comprising a step of bringing the aluminiferous metal surface into contact with an aqueous liquid surface treatment composition which contains a composition as claimed in claim 4 and has a pH value not more than 6.5.

6. A method according to claim 5, wherein the contact between the aluminiferous metal surface and the aqueous liquid surface treatment composition is maintained for a time from 1 to 60 seconds at a temperature from 35 to 65° C., and the surface which has thus been brought into contact is rinsed with water after discontinuance of the contact and is subsequently dried.

7. A method according to claim 6, wherein the dried surface formed is heated to a temperature of at least 200° C. for a time of at least 1 minute in the ambient atmosphere.

8. A method according to claim 7, wherein the surface treatment composition has a pH from 2.0 to 6.5 and comprises:

from 1 to 30 g/l of component (A);

from 0.1 to 10 g/l of component (B);

from 0.1 to 10 g/l of component (C); and from 0.1 to 20 g/l of component (D).

9. A method for the treatment of an aluminiferous metal surface, comprising a step of bringing the aluminiferous metal surface into contact with an aqueous liquid surface treatment composition which contains a composition as claimed in claim 3 and has a pH value not more than 6.5.

10. A method according to claim 9, wherein the contact between the aluminiferous metal surface and the aqueous liquid surface treatment composition is maintained for a time from 1 to 60 seconds at a temperature from 35 to 6520 C., and the surface which has thus been brought into contact is rinsed with water after discontinuance of the contact and is subsequently dried.

11. A method according to claim 10, wherein the dried surface formed is heated to a temperature of at least 200° C. for a time of at least 1 minute in the ambient atmosphere.

12. A method according to claim 11, wherein the surface treatment composition has a pH from 2.0 to 6.5 and comprises:

from 1 to 30 g/l of component (A);

from 0.1 to 10 g/l of component (B);

from 0.1 to 10 g/l of component (C); and from 0.1 to 20 g/l of component (D).

13. A method for the treatment of an aluminiferous metal surface, comprising a step of bringing the aluminiferous metal surface into contact with an aqueous liquid surface treatment composition which contains a composition as claimed in claim 2 and has a pH value not more than 6.5.

14. A method according to claim 13, wherein the contact between the aluminiferous metal surface and the aqueous liquid surface treatment composition is maintained for a time from 1 to 60 seconds at a temperature from 35 to 65° C., and the surface which has thus been brought into contact is rinsed with water after discontinuance of the contact and is subsequently dried.

15. A method according to claim 14, wherein the dried surface formed is heated to a temperature of at least 200° C. for a time of at least 1 minute in the ambient atmosphere.

16. A method according to claim 15, wherein the surface treatment composition has a pH from 2.0 to 6.5 and comprises:

from 1 to 30 g/l of component (A);

from 0.1 to 10 g/l of component (B);

from 0.1 to 10 g/l of component (C); and from 0.1 to 20 g/l of component (D).

17. A method for the treatment of an aluminiferous metal surface, comprising a step of bringing the aluminiferous metal surface into contact with an aqueous liquid surface treatment composition which contains a composition as claimed in claim 1 and has a pH value not more than 6.5.

18. A method according to claim 17, wherein the contact between the aluminiferous metal surface and the aqueous liquid surface treatment composition is maintained for a time from 1 to 60 seconds at a temperature from 35 to 65° C., and the surface which has thus been brought into contact is rinsed with water after discontinuance of the contact and is subsequently dried.

19. A method according to claim 18, wherein the dried surface formed is heated to a temperature of at least 200° C. for a time of at least 1 minute in the ambient atmosphere.

20. A method according to claim 19, wherein the surface treatment composition has a pH from 2.0 to 6.5 and comprises:

from 1 to 30 g/l of component (A);

from 0.1 to 10 g/l of component (B);

from 0.1 to 10 g/l of component (C); and from 0.1 to 20 g/l of component (D).

* * * * *